United States Patent [19]

Gebert

[11] Patent Number: 4,928,968

[45] Date of Patent: May 29, 1990

[54] SPINNING TOP AND PROJECTILE GAME

[76] Inventor: Paul Gebert, 4 Benham Cir., Cartersville, Ga. 30120

[21] Appl. No.: 371,923

[22] Filed: Jun. 27, 1989

[51] Int. Cl.[5] ..... A63B 67/12; A63B 69/40; A63F 9/16

[52] U.S. Cl. ..... 273/357; 273/353; 273/355; 273/399

[58] Field of Search ..... 273/353, 355, 357, 356, 273/114, 115–117, 119 R, 138 R, 398, 399, 147, 400

[56] References Cited

U.S. PATENT DOCUMENTS

| | | | |
|---|---|---|---|
| 1,468,984 | 9/1923 | Weaver | 273/142 G |
| 1,977,814 | 10/1934 | Warner | 273/110 |
| 4,210,331 | 7/1980 | Kulesza et al. | 273/123 R |

*Primary Examiner*—Edward M. Coven
*Assistant Examiner*—W. Pierce
*Attorney, Agent, or Firm*—John L. James

[57] ABSTRACT

An apparatus and method for a game of skill has a bottom member with a plurality of pockets and a top member. The top member has a base with a plurality of openings therein, a sidewall attached to the base and a cover having a central opening attached to the sidewall. A spindle connects the top and bottom members, and the top member is rotatable about the spindle whereby each of the openings is vertically aligned with each of the pockets during each revolution of the top member. A flipper is attached to the base for hurling a projectile into a cup on the top member. Projectiles missing the cup pass through the openings into the plurality of pockets as the top member rotates.

17 Claims, 2 Drawing Sheets

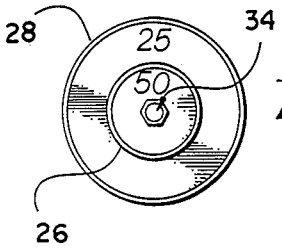
Fig_5
Fig_3
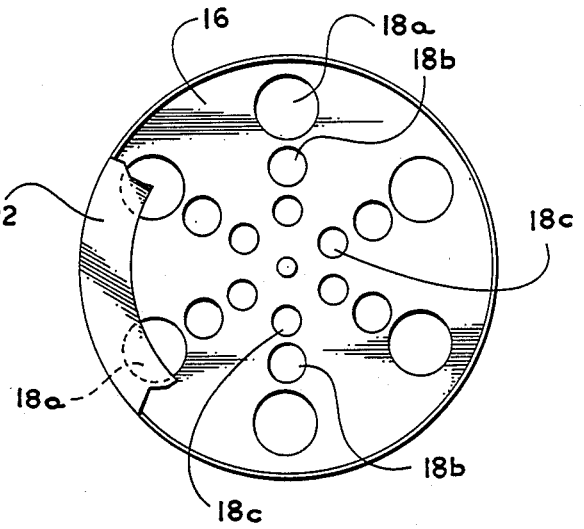
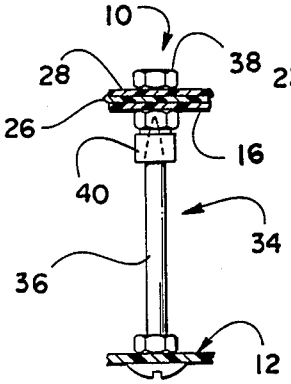
Fig_4
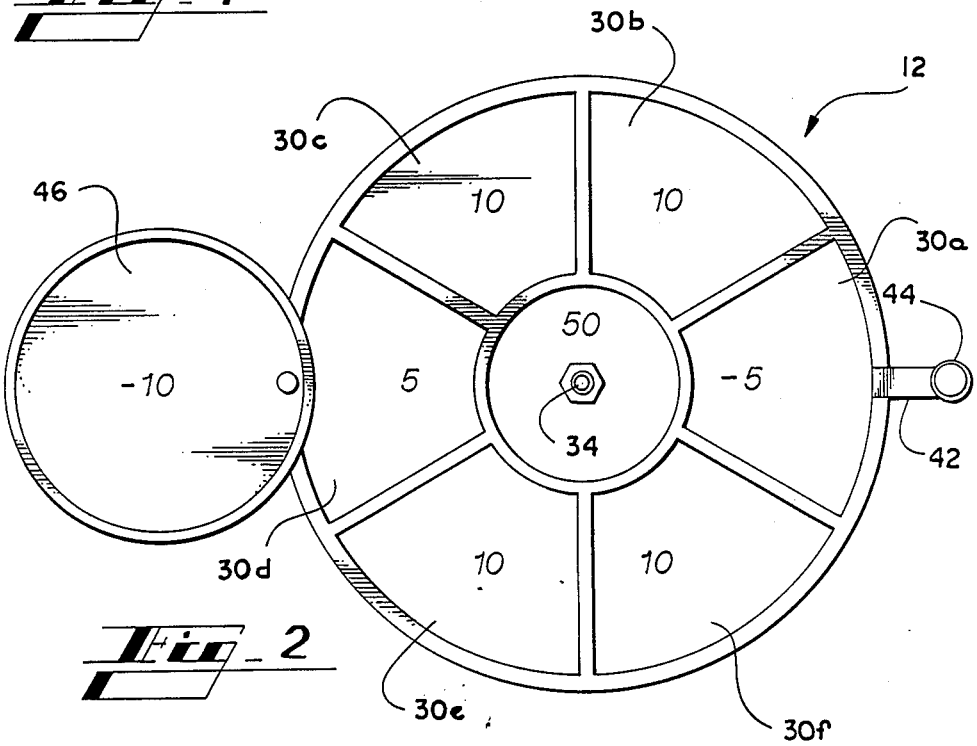
Fig_2

SPINNING TOP AND PROJECTILE GAME

CROSS REFERENCE TO RELATED APPLICATIONS

This application is related to application Docket No. G 02 A 01, ORBITAL SPINNER, filed herewith, and application Docket No. G 02 A 03, ROVING SPINING TOP PUZZLE, filed herewith, by the present inventor.

TECHNICAL FIELD

This invention relates generally to amusement devices, and more particularly relates to a spinning top and projectile apparatus and method for playing a game that challenges the coordination and reflex action of the player.

BACKGROUND OF THE INVENTION

Amusement devices and games are enjoyed by people all over the world. Virtually every person uses some sort of amusement device or plays with a toy or game. Unfortunately, many games require two or more persons to play and may take hours to complete. It is desirable to have a game that can be played quickly and can be played by a single person as well as by a group of persons.

A problem with some games is that the games include an element of chance. Some games, for example, introduce an elelment of chance with dice or cards so that the outcome is skewed by the roll of the dice or the lay of the cards. Such an element of chance diminishes the skill level required for the games. It is highly desirable to have a game that limits the element of chance and relies primarily on the skill and reflexes of the player.

There are games that are very difficult to play with pages of complicated instructions and rules. The equipment required to play some games is extremely bulky and not easily transported. It will be appreciated that it would be highly desirably to have a game that uses transportable equipment so that the game can be conveniently played at various times and locations.

The number of games available for handicapped persons who are confined to bed or a wheelchair is limited. Similarly, some games cannot be enjoyed by persons who have limited use of their legs, are hearing impaired, or mentally impaired. Also, games requiring the use of the legs are difficult, if not impossible, to play in confined areas such as a bus, train or airplane. It is therefore desirable to have a game that can be enjoyed by adults, children and handicapped persons, and can be played when traveling by automobile, bus, train or airplane.

There are many cafes, bars and lounges that are frequented by thousands of persons each day to eat, listen to music, watch wide screen television, rendezvous, mingle and socialize. Bars, cafes and lounges are often convenient waiting places for travelers between flights and for business people between meetings. It will be appreciated that it would be highly desirable to have a game that could be played while people are waiting at a bar or in a cafe that does not tax the mental capacity of the player so that the game does not interfere with other mental activities.

SUMMARY OF THE INVENTION

The present invention is directed to overcoming one or more of the problems set forth above. Briefly summarized, according to one aspect of the invention, a game of skill has a bottom member with a plurality of pockets, and a top member. The top member has a base with a plurality of openings therein, a sidewall attached to said base, and a cover having a central opening attached to the sidewall. A spindle connects the top and bottom members with the top member being rotatable about the spindle whereby each of the openings is vertically aligned with each of the pockets during each revolution of the top member.

According to another aspect of the invention, a method for playing a game includes placing an apparatus on a stable surface. The apparatus comprises a bottom member with a plurality of pockets, a top member having a base with a plurality of openings therein, a sidewall attached to the base, a cover having a central opening and attached to the sidewall, and a spindle connecting the top and bottom members. The top member is rotatable about the spindle so that each of the openings is vertically aligned with each of the pockets during each revolution of the top member. The method includes rotating the top member, and flipping a projectile toward the central opening of the top member. The method further includes assigning a numerical point value of a center cup, guiding the projectile toward the center cup, and catching the projectile in the center cup.

The present invention uses equipment that is fairly simple in both construction and operation, and is easily transported so that the game can be played at any time and anywhere. Becauses the equipment is simple, the game can be enjoyed by handicapped persons and can be played when traveling by automobile, bus, train or airplane.

The game can be played quickly and can be played by a single person as well as by a group of persons. It is therefore a suitable game for playing while waiting in a cafe, bar, restaurant or lounge. It is also ideally suited for public waiting areas in airports and the like.

The game relies mainly on the skill of the player and is therefore a game that can be used in tournaments and other events that require or highlight player skill.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 2 is a top view of the bottom member of FIG. 1.

FIG. 3 is a bottom view of the top member of FIG. 1.

FIG. 4 is a side view of the spindle assembly of FIG. 1.

FIG. 5 is a top view of a cup assembly of the top member of FIG. 1.

DETAILED DESCRIPTION OF THE PREFERRED EMBODIMENTS

Figure 1:
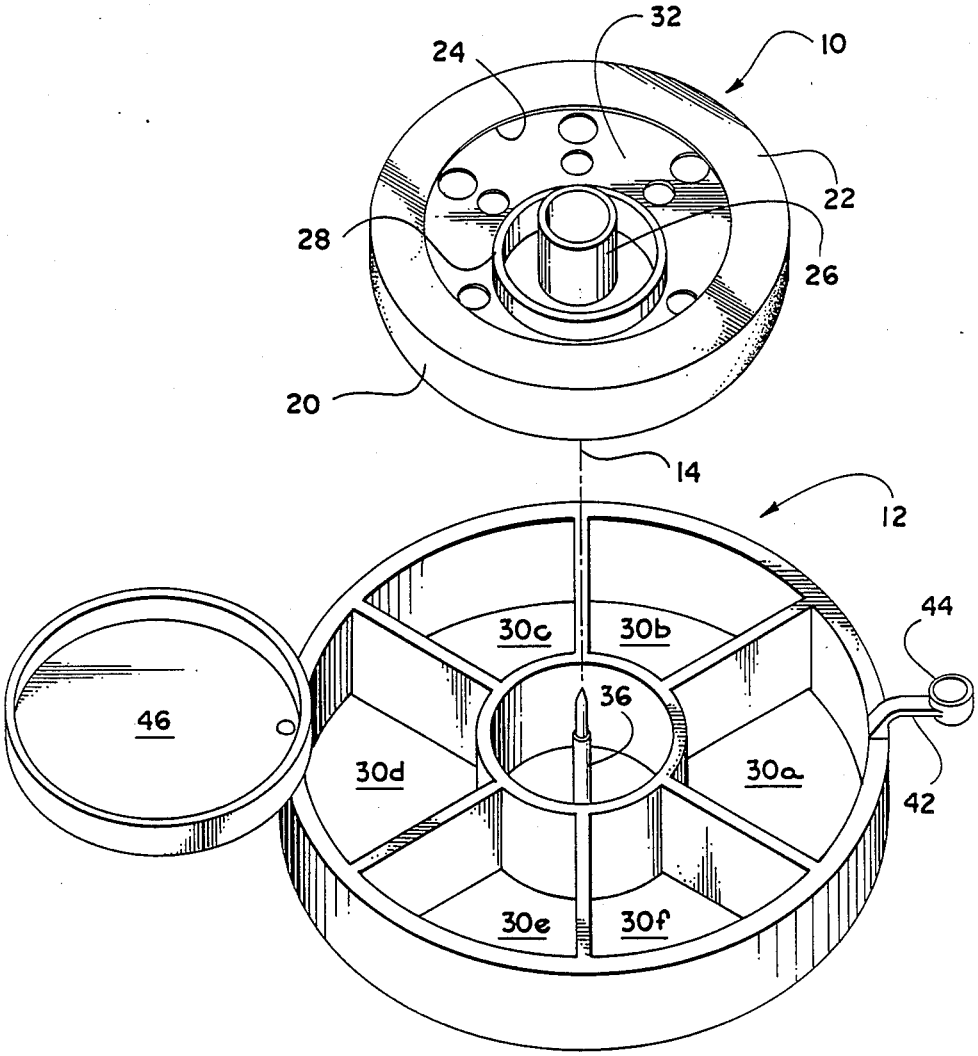
FIG. 1 is a diagrammatic perspective view of a preferred embodiment of spinning top and projectile apparatus having a top member and a bottom member connected by a spindle assembly in accordance with the present invention.

Referring now to the drawings, in which like numerals indicate like elements throughout the several figures, FIG. 1 illustrates an apparatus for playing a game of skill and coordination. The apparatus includes a top member 10 and a bottom member 12. The top member 10 is positioned at a higher elevation than the bottom member 12, and rotates relative to the bottom member 12 about a vertical axis 14.

Referring to FIGS. 1 and 3, the top member 10 has a base 16 with a plurality of openings, 18*a–c*, a sidewall 20 attached to the base 16 and a cover 22 that has a central opening 24. The cover 22 is attached to the sidewall 20. The sidewall 20 preferably is of a short cylindrical configuration, and the cover 22 is circular with a central circular opening 24.

Referring to FIGS. 1 and 5, the top member 10 has a first center cup 26 mounted on the base 16 of the top member 10 and vertically aligned with the central vertical axis 14. The first center cup 26 is attached to the top member 10 and rotates therewith about the vertical axis 14. A second center cup 28 is also mounted on the base 16 of the top member 10 concentric withthe first center cup 26. The second center cup 28 has a larger diameter than the first center cup 26. The first center cup 26 has an assigned point value of +50 and the second center cup 28 has an assigned point value of +25.

Referring to FIGS. 1–2, the bottom member 12 has plurality of pockets 30*a–f*. The bottom member 12 also has a center pocket 32 centrally positioned between pockets 30*a–f*. Each of the plurality of pockets 30*a–f* is assigned a numerical point value that may be positive or negative. As illustrated, pocket 30*a* has a negative assigned point value while pockets 30*b–f* have positive values. Pocket 30*a* has a value of −5, pocket 30*d* has a value of +5, and pockets 30*b–c* and 30*e–f* each have a value of +10. Pockets 30*a* and 30*d* are smaller than pockets 30*b–c* and 30*e–f*. The central pocket 32 has an assigned point value of +50.

Referring to FIGS. 1 and 4, a spindle assembly 34 connects the top member 10 and the bottom member 12. The top member 12 is rotatable on the spindle 34 whereby each of the openings 18*a–b* is vertically aligned with each of the pockets 30*a–f* during each revolution of the top member 10. Also, each of the openings 18*c* is vertically aligned with the center pocket 32. The openings 18*a* are larger than openings 18*b*, and openings 18*b* are larger than openings 18*c*. The openings 18 are arranged with the smaller openings 18*c* near the spindle 34 and the larger openings 18*a* near the sidewall 20.

The spindle assembly 34, in a simple configuration, consists of a shaft 36 fastened to the bottom member 12 with two nuts, 38, 40 threaded on its upper end portion with the nut 38 above the base 16 of the top member 10 and the nut 40 below the base 16 of the top member 10. The shaft 36 extends through an opening in the base member 16 with the base member 16 able to rotate thereabout between the nuts 30,40.

Referring to FIGS. 1–2, the bottom member 12 preferably has a flipper 42 attached thereto. The flipper 42 has a cup 44 thereon. The flipper 42 is preferably mounted on the bottom member 12 at a location sufficient for flipping a projectile from the flipper 44 toward the opening 24 in the cover 22 of the top member 10. An overflow pocket 46 is also attached to the bottom member 12 generally diametrically opposite the flipper 42. The overflow pocket 46 has a numerical point value assigned thereto of −10. As illustrated, the flipper 42 is mounted adjacent the negative pocket 30*a* and the overflow pocket 46 is mounted adjacent small pocket 30*d*.

Referring to FIG. 1, the second center cup 28 partially blocks openings 18*c* thereby making it more difficult for projectiles to pass through openings 18*c* into the center pocket 32 below.

While operation of the present invention is believed to be apparent from the foregoing description, a few words will be added for emphasis. The apparatus is used by placing the apparatus on a stable surface and spinning the top member 10 about the vertical axis 14. While the top member 10 is spinning, a projectile, such as marble for example, is placed in the flipper cup 44. The flipper 42 is depressed and released hurling the projectile toward the opening 24 in the cover 22 of the top member 10 and toward the first center cup 26 to attain a high point value when the projectile lands, hopefully in the center cup 26.

The object of the game is to guide the projectile, as much as possible, toward the center cup 26 to obtain the high point value. If the first center cup 26 does not catch the projectile, then the second center cup 28, with a lower point value, has an opportunity to catch the projectile. When both cup 26, 28 fail to capture the projectile, then the projectile may land in the bottom of the top member 10 and eventually fall through one of the openings 18*a–c*. If the projectile passes through one of the openings 18*a–b*, there is a high probability that the projectile will land in one of the pockets 30*a–f*, and a low probability that it will land in the center pocket 32. Pocket 30*a* is the least desirable because of its negative point value.

Releasing the projectile with too much energy may cause the projectile to overshoot the center opening 24 and land in the overflow cup 46 for negative points. Releasing the projectile with too much energy may cause the projectile to overshoot or miss both the center opening 24 and the overflow cup 46 for arbitrarily assigned negative points. The arbitrarily assigned negative points have a greater negative magnitude than the negative points of the overflow cup 46.

When landing in the base of the top member 10, the projectile also has an opportunity to pass through the smaller openings 18*c* and land in the central pocket 32 to attain a high point value. Although it is possible for the projectile to land in the high value pocket 32, it is difficult for the projectile to pass through the small openings 18*c* because the openings 18*c* are smaller than the other openings 18*a–b* and also because these pockets abut the second central cup 28 and the cup 28 may even partially block the openings 18*c*.

It will now be appreciated that there has been disclosed an apparatus and method for playing a game that challenges the coordination and reflexes of the player. A single person can play the game with the apparatus according to the method of the present invention. The game can be played quickly and can also be played by a group of persons and groups may compete against one another. Unlike some games that depend heavily on the luck of the player, the present invention relies primarily on the skill and reflexes of the player. The equipment required to play is transportable so that the game can be played at any time and anywhere. The game can be enjoyed by adults, children and handicapped persons and can be played when traveling by automobile, bus, train or airplane. It can also be played while waiting at a bar or in a cafe without taxing the mental capacity of the player so that it does not interfere with other mental activties. While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teaching of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

I claim:

1. An apparatus, comprising:

a bottom member having a plurality of pockets;

a top member having a base with plurality of openings therein, a sidewall attached to said base and a cover having a central opening attached to said sidewall;

a spindle connecting said top and bottom members, said top member being rotatable about said spindle whereby each of said openings is vertically aligned with each of said pockets during each revolution of said top member; and a first center cup mounted on said base of said top member and vertically aligned with said spindle.

2. An apparatus, as set forth in claim 1, including a flipper having a cup thereon and being mounted on said bottom member at a location sufficient for flipping a projectile from said cup toward said opening in said cover of said top member.

3. An apparatus, as set forth in claim 2, including an overflow pocket on said bottom member diametrically opposite said flipper.

4. An apparatus, as set forth in claim 1, wherein said first center cup is attached to said top member and rotates with said top member.

5. An apparatus, as set forth in claim 1, including a second center cup mounted on said base of said top member concentric with said first center cup.

6. An apparatus, as set forth in claim 5, wherein said first and second center cups each have a positive number thereon higher than any numbers on said pockets of said bottom member.

7. An apparatus, as set forth in claim 6, wherein said first center cup is smaller than said second center cup and has higher number thereon than said second center cup.

8. An apparatus, as set forth in claim 1, wherein said plurality of openings in said top member are arranged with smaller openings near said spindle and larger openings toward said sidewall.

9. An apparatus, comprising:

a bottom member having a plurality of pockets;

a top member having a base with a plurality of openings therein, a sidewall attached to said base and a cover having a central opening attached to said sidewall;

a spindle connecting said top and bottom members, said top member being rotatable about said spindle whereby each of said openings is vertically aligned with each of said pockets during each revolution of said top member; and a flipper having a cup thereon and being mounted on said bottom member at a location sufficient for flipping a projectile from said cup toward said opening is said cover of said top member, said pocket adjacent said flipper having a negative number thereon.

10. An apparatus, comprising:

a bottom member having a plurality of pockets;

a top member having a base with a plurality of openings therein, a sidewall attached to said base and a cover having a central opening attached to said sidewall;

a spindle connecting said top and bottom members, said top member being rotatable about said spindle whereby each of said openings is vertically aligned with each of said pockets during each revolution of said top member;

a flipper having a cup thereon and being mounted on said bottom member at a location sufficient for flipping a projectile from said cup toward said opening is said cover of said top member; and an overflow pocket on said bottom member generally diametrically opposite said flipper, said overflow pocket having a negative number thereon.

11. An apparatus, comprising:

a bottom member having a plurality of pockets including a center pocket centrally positioned between said plurality of pockets;

a top member having a base with a plurality of openings therein, a sidewall attached to said base and a cover having a central opening attached to said sidewall; and a spindle connecting said top and bottom members, said top member being rotatable about said spindle whereby each of said openings is vertically aligned with each of said pockets during each revolution of said top member.

12. An apparatus, as set forth in claim 11, wherein said center pocket has a number thereon higher than any number on said plurality of pockets.

13. An apparatus, as set forth in claim 11, including a second center cup mounted on said base of said top member concentric with said first center cup, said second cup partially blocks selected openings of said plurality of openings thereby making it more difficult for a projectile to pass through said selected openings into said center pocket.

14. A metod of play, comprising:

placing an apparatus on a stable surface, said apparatus comprising a bottom member having a plurality of pockets, a top member having a base with a plurality of openings therein, a sidewall attached to said base, a cover having a central opening and being attached to said sidewall, and a spindle connecting said top and bottom members, said top member being rotatable about said spindle whereby each of said openings is vertically aligned with each of said pockets during each revolution of said top member;

rotating said top member; and flipping a projectile toward said central opening of said top member.

15. A method, as set forth in claim 14 including:

assigning a numerical point value to center cup;

guiding said projectile toward said center cup; and catching said projectile in said center cup.

16. A method, as set forth in claim 15, including noting the point value.

17. A method, as set forth in claim 14, including:

assigning numerical point values to said pockets;

guiding said projectile through said vertically aligned openings and pockets into selected pockets; and noting the point value of said pocket wherein said projectile comes to rest.

* * * * *